US007243865B2

(12) United States Patent
Jarchau

(10) Patent No.: US 7,243,865 B2
(45) Date of Patent: Jul. 17, 2007

(54) NOZZLE FOR GENERATING A HIGH-PRESSURE JET

(75) Inventor: Michael Jarchau, Oelde (DE)

(73) Assignee: Hammelmann Maschinenfabrik GmbH, Oelde (DE)

( * ) Notice: Subject to any disclaimer, the term of this patent is extended or adjusted under 35 U.S.C. 154(b) by 247 days.

(21) Appl. No.: 10/683,284

(22) Filed: Oct. 14, 2003

(65) Prior Publication Data

US 2004/0164173 A1 Aug. 26, 2004

(30) Foreign Application Priority Data

Oct. 17, 2002 (DE) ..... 102 48 357

(51) Int. Cl.

| | |
|---|---|
| ***A62C 31/02*** | (2006.01) |
| ***B05B 1/00*** | (2006.01) |
| ***F23D 11/38*** | (2006.01) |
| ***F23D 14/48*** | (2006.01) |

(52) U.S. Cl. ..... 239/589; 239/590; 239/601; 239/DIG. 19; 239/599; 239/589; 222/566; 222/572

(58) Field of Classification Search ..... 239/591, 239/589, 590, 601, DIG. 19, 599; 222/566, 222/572

See application file for complete search history.

(56) References Cited

U.S. PATENT DOCUMENTS

| | | | | |
|---|---|---|---|---|
| 4,349,947 A | | 9/1982 | Rood | |
| 5,033,681 A | * | 7/1991 | Munoz | 239/596 |
| 5,730,358 A | | 3/1998 | Raghavan et al. | |
| 5,848,753 A | * | 12/1998 | Wands et al. | 239/596 |
| 5,893,520 A | | 4/1999 | Elkas | |
| 6,176,442 B1 | * | 1/2001 | Eicher et al. | 239/591 |
| 6,668,436 B2 | * | 12/2003 | Noelle et al. | 28/167 |
| 6,722,588 B1 | * | 4/2004 | Elkas | 239/596 |
| 6,817,550 B2 | * | 11/2004 | Taylor et al. | 239/591 |

FOREIGN PATENT DOCUMENTS

| | | |
|---|---|---|
| CH | 567 907 | 10/1975 |
| DE | G 94 19 809.8 | 12/1994 |
| DE | 94 19 809.8 | 1/1995 |
| DE | 195 36 903 C2 | 9/1998 |
| DE | 198 49 814 A1 | 5/2000 |
| WO | WO 00/47329 | 8/2000 |
| WO | WO 01/44553 A1 | 6/2001 |

* cited by examiner

*Primary Examiner*—Kevin Shaver
*Assistant Examiner*—James S. Hogan
(74) *Attorney, Agent, or Firm*—Barnes & Thornburg LLP

(57) ABSTRACT

A nozzle for generating a high-pressure jet of a flowable medium, having a nozzle body and a nozzle disk which is embedded in the nozzle body in a recess. The nozzle body includes an axial nozzle bore which leads into at least one of an inlet bore and an outlet bore. The nozzle disk rests under compressive strain on contact surfaces of the recess. Also included is a method for creating a nozzle having a nozzle disk embedded in a nozzle body, the steps comprising: providing a nozzle disk; forming a nozzle body around the nozzle disk in a recess so as to create compressive strain on contact surfaces of the nozzle disk.

14 Claims, 2 Drawing Sheets

NOZZLE FOR GENERATING A HIGH-PRESSURE JET

CROSS-REFERENCE

This non-provisional application claims the benefit of German Application Number 102 48 3574-51, filed Oct. 17, 2002 in Germany and which disclosure is hereby incorporated by reference herein.

BACKGROUND

The present disclosure relates to a nozzle for generating a high-pressure jet of a flowable nozzle for generating a high-pressure jet of a flowable medium, having a nozzle body and a nozzle disk which is embedded in the nozzle body in a recess. The nozzle body includes an axial nozzle bore which leads into at least one of an inlet and an outlet bore.

Such a nozzle is a component of a nozzle head which is used, for example, as a water jet nozzle in the high-pressure water jet technology field. Such a water jet nozzle is used, for example, for the cleaning of surfaces, the removal of coatings, the roughening of surfaces as well as the cutting and separating of materials.

For generating the high-pressure jet, the pressure generated by a pump in a volume flow of the medium is converted by a diminishing of the cross-section of the nozzle into a jet, preferably a liquid jet, having a high velocity. Water is normally used as the liquid. The generated pressures can amount to up to 4,000 bar and more, while the velocity is at up to 900 m/s.

Because of the resulting extremely high stressing of the nozzle disk, it is known from German Patent Document DE 94 19 809 U1 to produce this nozzle disk of a sapphire.

However, for obtaining a fairly acceptable service life, it is necessary to machine the nozzle disk as well as the recess, in which it is disposed, within very narrow tolerance limits with respect to the parallelism of the contact surfaces, the concentricity and the angularity as well as the dimensional accuracy. Apart from the fact that this can be done only at considerable manufacturing expenditures, even the low tolerances result in an extremely high stressing of the nozzle disk during the operation, which has a considerable influence on the service life.

Although it is not explicitly mentioned in German Patent Document DE 94 19 809 U1, in practice, the nozzle disk is provided with a sealing ring which is made of a nonferrous heavy metal alloy or of a plastic material and which seals the nozzle disk off with respect to the lateral wall area of the recess of the nozzle body.

However, the sealing ring is not capable of laterally supporting the nozzle disk, as would be required for absorbing tensions acting upon the nozzle disk, which tensions are generated by the high internal pressure in the nozzle bore. This non-existing radial support of the nozzle disk frequently leads to cracks and breaks during the operation, which results in dangerous situations, particularly when such nozzles are used in manually guided tools, such as spray guns or the like. As a result of the abrupt relaxation of the pressure during the breaking of the nozzle disk, the recoil power rises unexpectedly and unacceptably high, which may endanger the user of the spray gun.

In the case of the known nozzle, an axial prestressing force is applied to the nozzle disk as well as the nozzle body by way of a pressure screw. In this case, the force is guided to the nozzle body by way of the nozzle disk and the sealing ring.

However, this requires that corresponding height tolerances of the components are observed at high manufacturing expenditures. Nevertheless, an exceeding of the tightening torque on the pressure screw may result in a breaking of the brittle nozzle disk. This occurs relatively frequently because many nozzles are used and mounted under rough operating conditions, for example, at construction sites for the renewal of concrete.

The above-mentioning absent radial support of the nozzle disk also leads to high stress caused by dirt particles situated in the jet liquid which, when impacting on the assigned face of the nozzle disk, may also result in cracks with the above-described effects.

The present disclosure relates to a nozzle that may be produced more easily, that may have its service life prolonged, and that may have its operational reliability improved.

Thus, the present disclosure includes a nozzle for generating a high-pressure jet of a flowable medium, having a nozzle body and a nozzle disk which is embedded in the nozzle body in a recess. The nozzle body includes an axial nozzle bore which leads into at least one of an inlet and an outlet bore. The nozzle disk rests under compressive strain on contact surfaces of the recess.

The nozzle disk rests in the recess of the nozzle body in a virtually fixedly clamped-in manner, specifically in all stress situations possible during the operation of the nozzle.

In particular, effective radial forces, which result from the internal operating pressure within the nozzle bore, are directed directly onto the nozzle body. As a result, the nozzle disk becomes extremely resistant, so that a sudden crack formation or breaking is virtually excluded. The sensitivity with respect to dirt particles is also considerably reduced.

The nozzle body with the inserted nozzle disk is produced as a constructional unit and can be assembled such that no direct pressure forces act upon the nozzle disk during the assembly, for example, by a pressure screw or an inflow body operating in this manner.

The nozzle disk can be arranged in the interior of the nozzle body. This means that the nozzle disk is enclosed on all sides by the nozzle body.

Applied tension forces for fixing the nozzle body are thereby guided exclusively into the nozzle body.

This is also the case when the nozzle disk rests in the recess made on the face-side in the nozzle body. The inflow body, as the pressure piece, braces the nozzle body against a housing bottom, and the tension pressure originating from the inflow body is guided outside the nozzle disk into the nozzle body.

The nozzle body is produced by sintering or casting, in which case the nozzle disk is inserted beforehand so that it is completely enclosed by the material of the nozzle body after the casting or sintering.

As a result, a special machining precision with respect to the nozzle disk is not necessary which naturally saves expenses.

The nozzle body material, into which the nozzle disk is first embedded without any nozzle bore, is preferably corrosion-resistant and of a high strength.

By the sintering process or the casting, high constant compressive strain is applied to the contact surfaces of the nozzle disk, which compressive strain results in favorable operation of the nozzle.

After the termination of the sintering or casting, the exterior surfaces or sealing surfaces of the sealing body are produced, and an exit bore and possibly an entry bore and the nozzle bore are provided. As a result, a high concentricity is reached which leads to an optimization of the medium jet emerging from the nozzle.

Since an operationally caused breaking of the nozzle disk is virtually excluded, the operational reliability for the user may be increased in comparison to the known nozzle. Furthermore, the service life may also be prolonged, and may rise additionally because of the fact that the nozzle body with the embedded nozzle disk has a mirror-symmetrical construction in the longitudinal as well as the transverse axial direction. This permits a turning of the nozzle body in the event that the inlet area of the nozzle bore has been worn as a result of the operation. In this case, the nozzle body with the enclosed nozzle disk is only turned by 180°, so that the previous outlet side of the nozzle bore will now form the inlet side.

The nozzle disk can include a mechanically resistant ceramic material, preferably a sapphire, a ruby, a polycrystalline diamond or a mixed ceramics.

In addition to the above-mentioned possibility of embedding the nozzle disk by casting or sintering the nozzle body, there is also the possibility of soldering the nozzle disk to the nozzle body, preferably by means of hard-soldering.

In each case, the robust construction of the nozzle also permits the building-in of fan jet geometries of the nozzle bore, which may then have a cross-section which deviates from the circular shape, for example, an elliptical or rectangular shape. To this extent, the present disclosure envisions an expanded field of usage.

For prolonging the service life, in addition to the above-mentioned turning possibility of the nozzle body, the nozzle bore can be refinished, particularly in the area of the entry edge, so that, on the whole, an improvement may be obtained from an industrial management point of view.

Additional aspects of the present disclosure are included in the subject matter of the dependent claims.

Other aspects of the present disclosure will become apparent from the following descriptions when considered in conjunction with the accompanying drawings.

DETAILED DESCRIPTION OF THE DRAWINGS

Figure 1:
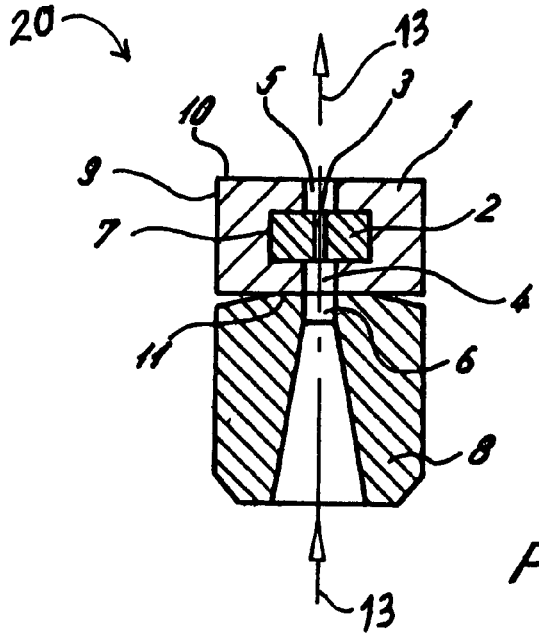
FIGS. 1 and 2 each are longitudinal sectional views of a nozzle, according to the present disclosure.
Figure 2:
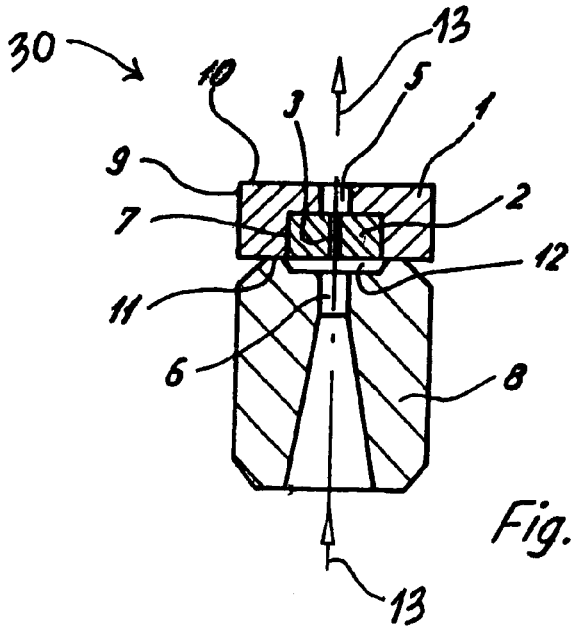

FIGS. 1 and 2 each show a nozzle 20, 30 respectively, for generating a high-pressure jet of a flowable medium, for example, a liquid, a liquid solids gas mixture or a gas. Each nozzle 20, 30 has a nozzle body 1, and a nozzle disk 2 resting or embedded in the nozzle body 1 inside a recess 7. The nozzle body 1 may be made of a high-strength material, and may also be corrosion and acid resistant. Each nozzle 20, 30 may also have an axial nozzle bore 3, that may be centric, as well as an inflow or inlet body 8 by which the nozzle body 1 can be fixedly braced to a nozzle head in a nozzle housing, neither of which is shown.

The inflow body 8, which, on a side facing the nozzle body 1, has an axially arranged feeding duct 6 through which the medium can be fed under pressure in a direction of arrow 13, rests against the nozzle body 1 while forming a sealing surface 11 on the side facing the nozzle body 1.

According to the present disclosure, in the nozzles 20, 30, the nozzle disks 2, have a rotationally or cylindrical symmetrical shape, and rest under compressive strain on contact surfaces of the recess 7. In addition to having a cylindrical dimension, the nozzle disks 2 may, depending on requirements, also have other shapes.

In the nozzle 20 illustrated in FIG. 1, the nozzle disk 2 is completely enclosed by or encased or embedded in the nozzle body 1; that is, the nozzle disk 2 is completely encased.

In contrast, in the nozzle 30 illustrated in FIG. 2, the nozzle disk 2 rests laterally on a face of the nozzle body 1, situated opposite the inflow body 8, and under compressive strain against the recess 7. The sealing surface 11 is bounded toward a center area by a free cut 12 which overlaps a facing front side of the nozzle disk 2 to such an extent that the sealing surface 11 rests against the nozzle body 1 outside the nozzle disk 2.

In both nozzles 20, 30, the nozzle bore 3 leads into an outlet bore 5 of the nozzle body 1.

In the nozzle 20 illustrated in FIG. 1, the medium flowing through the feeding duct 6 is guided directly into an inlet bore 4 of the nozzle body 1 which is adjoined by the nozzle bore 3. In the nozzle 30 illustrated in FIG. 2, the medium is fed to the nozzle bore 3 through the free cut 12 which concentrically adjoins the feeding duct 6.

An embedding of the nozzle disk 2 into the nozzle body 1 takes place by: pouring of the high strength material around the nozzle disk 2; and forming the nozzle body 1 into a unit by sintering of the material; or, by soldering or hand-soldering the nozzle disk 2 to the nozzle body 1.

A machining of the unit to provide or make the nozzle bore 3, the inlet bore 4, the outlet bore 5, an exterior surface 9 and a sealing surface 10 of the nozzle body 1, which forms a face opposite the inlet body 8, takes place without the necessity of taking into account narrow tolerances.

Figure 3:
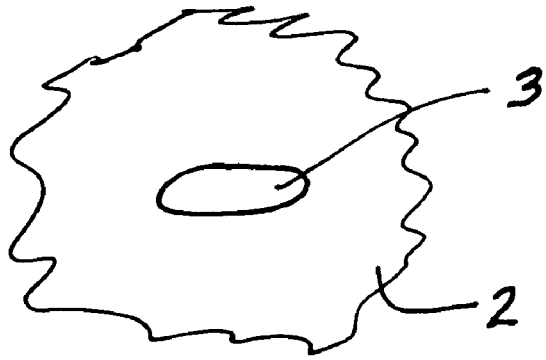
FIG. 3 is a top cut-away view of the nozzle of FIG. 1 showing the nozzle bore having an elliptical cross-section.
Figure 4:
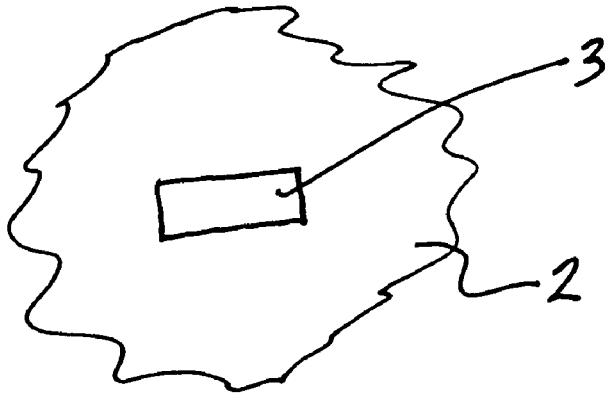
FIG. 4 is a top cut-away view of the nozzle of FIG. 1 showing the nozzle bore having a rectangular cross-section.

The nozzle bore 3 may have a cross-section which deviates from a circular shape. For example, the nozzle bore 3 may have an elliptical or rectangular shape, as suggested in FIGS. 3 and 4, respectively.

The present disclosure also includes a method for creating a nozzle having a nozzle disk under compressive strain, the steps comprising: providing a nozzle disk; forming a nozzle body around the nozzle disk in a recess so as to create compressive strain on contact surfaces of the nozzle disk.

Although the present disclosure has been described and illustrated in detail, it is to be clearly understood that this is done by way of illustration and example only and is not to be taken by way of limitation. The spirit and scope of the present disclosure are to be limited only by the terms of the appended claims.

I claim:

1. A nozzle for generating a high-pressure jet of a flowable medium, having a nozzle body and a nozzle disk which is embedded in the nozzle body in a recess, the nozzle body including an axial, nozzle bore which leads into at least one of an inlet and an outlet bore, the nozzle disk resting under compressive strain on contact surfaces of the recess;

wherein the nozzle body is braced by an inlet body against a nozzle housing, and wherein common pressure surfaces of the nozzle body and of the inlet body that form a sealing surface are situated outside the nozzle disk; and wherein on a front side facing the nozzle body, the inlet body has a concentric free cut overlapping the nozzle disk.

2. The nozzle according to claim 1, wherein the nozzle disk is completely embedded in the nozzle body.

3. The nozzle according to claim 1, wherein the nozzle body includes a corrosion- and acid-resistant material.

4. The nozzle according to claim 1, wherein the nozzle disk includes a polycrystalline diamond.

5. The nozzle according to claim 1, wherein the nozzle body includes high-strength material.

6. The nozzle according to claim 1, wherein the nozzle bore is a centric nozzle bore.

7. The nozzle according to claim 1, wherein the nozzle bore is circular in cross-section.

8. A nozzle for generating a high-pressure jet of a flowable medium, having a nozzle body and a nozzle disk which is embedded in the nozzle body in a recess, the nozzle body including an axial, nozzle bore which leads into at least one of an inlet and an outlet bore;

wherein the nozzle disk rests under compressive strain on contact surfaces of the recess; and wherein the nozzle body and the embedded nozzle disk have a mirror-symmetrical construction in the longitudinal as well as in the transverse direction.

9. The nozzle according to claim 8, wherein the nozzle disk is completely embedded in the nozzle body.

10. The nozzle according to claim 8, wherein the nozzle body includes a corrosion- and acid-resistant material.

11. The nozzle according to claim 8, wherein the nozzle disk includes a polycrystalline diamond.

12. The nozzle according to claim 8, wherein the nozzle body includes high-strength material.

13. The nozzle according to claim 8, wherein the nozzle bore is a centric nozzle bore.

14. The nozzle according to claim 8, wherein the nozzle bore is circular in cross-section.

* * * * *